US007985285B2

(12) United States Patent
Kiso et al.

(10) Patent No.: US 7,985,285 B2
(45) **Date of Patent: *Jul. 26, 2011**

(54) ELECTROLESS GOLD PLATING BATH, ELECTROLESS GOLD PLATING METHOD AND ELECTRONIC PARTS

(75) Inventors: Masayuki Kiso, Hirakata (JP); Yukinori Oda, Hirakata (JP); Seigo Kurosaka, Hirakata (JP); Tohru Kamitamari, Hirakata (JP); Yoshikazu Saijo, Hirakata (JP); Katsuhisa Tanabe, Hirakata (JP)

(73) Assignee: C. Uyemura & Co., Ltd., Osaka-Shi (JP)

( * ) Notice: Subject to any disclaimer, the term of this patent is extended or adjusted under 35 U.S.C. 154(b) by 791 days.

This patent is subject to a terminal disclaimer.

(21) Appl. No.: 11/987,880

(22) Filed: Dec. 5, 2007

(65) Prior Publication Data

US 2008/0138506 A1 Jun. 12, 2008

(30) Foreign Application Priority Data

Dec. 6, 2006 (JP) ..... 2006-328891

(51) Int. Cl.
*C23C 18/44* (2006.01)
*B05D 1/18* (2006.01)

(52) U.S. Cl. ..... 106/1.23; 106/1.26; 427/437

(58) Field of Classification Search ..... 106/1.23, 106/1.26; 427/437
See application file for complete search history.

(56) References Cited

U.S. PATENT DOCUMENTS

| | | | | | |
|---|---|---|---|---|---|
| 4,307,136 | A | * | 12/1981 | Prost-Tournier et al. | 106/1.23 |
| 4,792,469 | A | * | 12/1988 | Saito et al. | 106/1.26 |
| 5,380,562 | A | * | 1/1995 | Hattori et al. | 427/437 |
| 5,910,340 | A | * | 6/1999 | Uchida et al. | 106/1.23 |
| 2008/0138506 | A1 | * | 6/2008 | Kiso et al. | 106/1.23 |
| 2008/0138507 | A1 | * | 6/2008 | Kiso et al. | 106/1.23 |
| 2008/0277140 | A1 | * | 11/2008 | Kurosaka et al. | 427/443.1 |

FOREIGN PATENT DOCUMENTS

| | | | |
|---|---|---|---|
| JP | 2002-226975 | A | 8/2002 |
| JP | 2004-137589 | A | 5/2004 |
| WO | WO-2004/111287 | A2 | 12/2004 |

* cited by examiner

*Primary Examiner* — Helene Klemanski
(74) *Attorney, Agent, or Firm* — Birch, Stewart, Kolasch & Birch, LLP

(57) ABSTRACT

An electroless gold plating bath includes a water-soluble gold compound, a complexing agent, a formaldehyde metabisulfite adduct, and an amine compound represented by $R_1$—NH—$C_2H_4$—NH—$R_2$ or $(CH_2—NH—C_2H_4—NH—CH_2)_{n—R4}$ (wherein $R_1$ to $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$, and n is an integer of 1 to 4). A gold plated coating of a good appearance can be formed without causing a failure in appearance owing to the progress of intergranular corrosion in a nickel surface.

11 Claims, No Drawings

ELECTROLESS GOLD PLATING BATH, ELECTROLESS GOLD PLATING METHOD AND ELECTRONIC PARTS

CROSS-REFERENCE TO RELATED APPLICATION

This non-provisional application claims priority under 35 U.S.C. §119(a) on Patent Application No. 2006-328891 filed in Japan on Dec. 6, 2006, the entire contents of which are hereby incorporated by reference.

BACKGROUND OF THE INVENTION

This invention relates to an electroless gold plating bath, an electroless gold plating method using same, and electronic parts subjected to electroless gold plating by the method.

Gold exhibits the smallest ionization tendency among metals, meaning the most stable and most corrosion-resistant metal. In addition thereto, gold is excellent in electric conductivity and thus, has been in wide use in the fields of electronic industries. Immersion gold plating has been widely employed as a final surface treatment such as of circuits of printed board substrates and mounted portions or terminal portions of IC packages. In particular, the following methods are, for example, known with the following features, respectively.

(1) ENIG (Electroless Nickel Immersion Gold: electroless nickel/immersion gold)

- A method of forming an immersion gold plated coating formed on an underlying electroless nickel plated coating.
- Capable of preventing diffusion of copper, preventing oxidation of nickel, and improving a corrosion resistance of circuits or terminals.
- Usable for solder bonding.
- Usable in wire bonding by forming thickened gold after treatment of ENIG.
- With wire bonding, heat treatment is carried out after plating whereby nickel is diffused over a gold coating. To avoid this, electroless gold plating is performed on the nickel/immersion gold coating to increase the thickness of gold thereby coping with the diffusion of the nickel.

(2) DIG (Direct Immersion Gold: direct immersion gold)

- A method of directly forming, on copper, an immersion gold plated coating.
- Capable of preventing oxidation of copper, preventing diffusion of copper and improving a corrosion resistance of circuits and terminals.
- Usable in solder bonding and wire bonding.
- Well usable under conditions where a thermal load is not imposed appreciably (under conditions of a low thermal treating temperature, a reduced number of reflow cycles and the like) although long-term reliability is slightly inferior to that of nickel/gold, nickel/palladium/gold or the like.
- Low in cost because of its simple process.

(3) ENEPIG (Electroless Nickel Electroless Palladium Immersion Gold: electroless nickel/electroless palladium/immersion gold)

- A method of forming an electroless palladium plated coating between an underlying electroless nickel plated coating and an immersion gold plated coating.
- Capable of preventing diffusion of copper, preventing oxidation and diffusion of nickel, and improving a corrosion resistance of circuits and terminals.

- Most suited for lead-free solder bonding which has been recently facilitated (because a lead-free solder needs a greater thermal load upon solder bonding than a tin-lead eutectic solder, and with nickel/gold, the bonding characteristic lowers).
- Suited for wire bonding.
- No diffusion of nickel takes place if a gold thickness is not great.
- Suited for the case where better reliability is obtained although nickel/gold is applicable.

The immersion gold plating is such that gold is deposited by utilizing, in a plating bath, a difference in redox potential from an underlying layer such as of nickel, for which gold corrodes nickel to cause corrosion spots to occur owing to the oxidation (elution). The corrosion spots caused by the oxidation serve as an inhibition factor when tin and nickel in the solder layer are connected upon subsequent reflow of the solder, with the attendant problem that bonding characteristics such as strength lower.

In order to solve the problem, there have been disclosed an electroless gold plating bath including a sulfite adduct of aldehyde in Japanese Patent Laid-open No. 2004-137589 and a gold plating bath including a hydroxyalkylsulfonic acid in PCT Patent Publication No. WO 2004/111287, respectively. These techniques have for their object the suppression of corrosion of an underlying metal.

However, when primary amine compounds having an amino group (—$NH_2$) such as triethylenetetramine set out in WO 2004/111287 are used, intergranular corrosion proceeds in the nickel surface thereby lowering the coverage of gold, with the attendant disadvantage that the resulting coating becomes red in appearance.

DISCLOSURE OF THE INVENTION

The invention has been made under these circumstances and has for its object the provision of an electroless gold plating bath with which a gold plated coating of a good appearance can be obtained without causing a failure in appearance owing to the progress of intergranular corrosion in a nickel surface, an electroless gold plating method using the same, and electronic parts having subjected to electroless gold plating by the method.

We have made intensive studies so as to solve the above problem and, as a result, found that an electroless gold plating bath, which includes a water-soluble gold compound, a complexing agent, a formaldehyde metabisulfite adduct, and an amine compound having a specific type of structure represented by the following general formula (1) or (2).

$$R_1—NH—C_2H_4—NH—R_2 \quad (1)$$

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4), is able to form an electroless gold plated coating of a good appearance without causing a failure in appearance owing to the progress of intergranular corrosion in a nickel surface, thus arriving at completion of the present invention.

More particularly, the present invention provides the following electroless gold plating bath, electroless gold plating method and electronic parts.

[1] An electroless gold plating bath, including a water-soluble gold compound, a complexing agent, a formaldehyde metabisulfite adduct, and an amine compound represented by the following general formula (1) or (2).

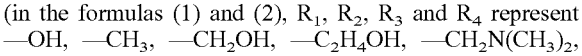

$$R_1—NH—C_2H_4—NH—R_2 \quad (1)$$

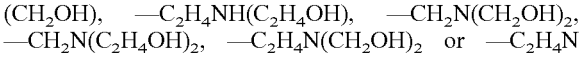

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, $C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4).

[2] The electroless gold plating bath, wherein a molar ratio between the formaldehyde metabisulfite adduct and the amine compound is such that formaldehyde metabisulfite adduct:amine compound=1:30 to 3:1.

[3] The electroless gold plating bath, wherein the water-soluble gold compound consists of a gold cyanide salt.

[4] An electroless gold plating method, including a step of plating a metal surface of a base by the electroless gold plating bath.

[5] The electroless gold plating method, wherein the metal surface of the base is a surface of copper or a copper alloy.

[6] The electroless gold plating method, wherein the metal surface of the base is a surface of nickel or a nickel alloy.

[7] The electroless gold plating method, wherein the nickel or nickel alloy is an electroless nickel or electroless nickel alloy plated coating.

[8] The electroless gold plating method, wherein the metal surface of said base is a surface of palladium or a palladium alloy.

[9] The electroless gold plating method, wherein said palladium or palladium alloy is an electroless palladium or electroless palladium alloy plated coating.

[10] The electroless gold plating method, wherein the metal surface of the base is a surface of an electroless palladium or electroless palladium alloy plated coating formed on an electroless nickel or electroless nickel alloy plated coating.

[11] An electronic part being processed electroless gold plating according to the electroless gold plating method.

BENEFITS OF THE INVENTION

According to the present invention, a gold plated coating of a good appearance can be formed without causing a failure in appearance owing to the progress of intergranular corrosion in a nickel surface.

DESCRIPTION OF THE PREFERRED EMBODIMENT

The invention is now described in detail.

The electroless gold plating bath of the invention includes a water-soluble gold compound, a completing agent, a formaldehyde metabisulfite adduct, and an amine compound represented by the following general formula (1) or (2).

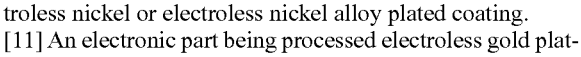

$$R_1—NH—C_2H_4—NH—R_2 \quad (1)$$

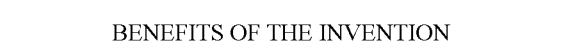

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4).

Unlike conventional immersion gold plating baths, the electroless gold plating bath of the present invention is an immersion/reduction type of electroless gold plating bath wherein both an immersion reaction and a reduction reaction proceed in the same plating bath. Because a formaldehyde metabisulfite adduct and an amine compound having a specific type of structure represented by the general formula (1) or (2) are contained in the gold plating bath, the electroless gold plating bath of the invention permits gold to be deposited on an underlying metal, such as copper, nickel or the like, by the immersion reaction and also permits gold to be deposited by means of the reducing agent using the deposited gold as a catalyst.

The electroless gold plating bath of the present invention is able to suppress corrosion of an underlying metal to minimum, so that elution of the underlying metal ion to the plating bath is lessened and a stable deposition rate is kept over a long-term use. For instance, with ordinary immersion plating, the amounts of deposited gold and an eluted underlying metal (e.g. copper or nickel) become equal according to stoichiometry. With the plating bath of the invention, where a direct electroless gold plating process is carried out using, for example, copper as an underlying metal, most of deposited gold is shifted from immersion plating to reduction plating, so that the deposition of the eluted underlying metal relative to deposited gold is very small and is suppressed to about ⅛ of conventional, ordinary immersion plating.

In this way, the corrosion of the underlying metal can be suppressed to minimum and a uniform dense gold plated coating can be obtained. Since the reducing agent is contained, gold is continuously deposited over once deposited gold, thereby enabling the coating to be thickened in one plating bath without performing a separate gold plating procedure for thickening. Additionally, the deposition rate of gold can be maintained stably and when the coating is made thick, a plated coating keeps a lemon yellow color inherent to gold without turning into a reddish color.

Where the underlying metal is made of palladium, a potential difference between palladium and gold is small, unlike the case of nickel or copper. For this reason, when gold plating is carried out on palladium by use of a conventional immersion gold plating bath, a uniform coating thickness cannot be obtained and a satisfactory thickness cannot be obtained as well. In contrast thereto, the electroless gold plating bath of the present invention is able to activate the surface of palladium and have gold deposited by means of a reducing agent using palladium as a catalyst. Moreover, gold can be further deposited by use of deposited gold as a catalyst, so that thickening of a gold plate coating on palladium is possible.

For the water-soluble gold compound contained in the electroless gold plating bath of the present invention, mention is made of gold cyanide salts such as gold cyanide, gold potassium cyanide, gold sodium cyanide, gold ammonium cyanide and the like, and gold sulfites, thiosulfate salts, thiocyanide salts, sulfate salts, nitrate salts, methansulfonate salts, tetramine complexes, chlorides, bromides, iodides, hydroxides, oxides and the like, of which gold cyanide salts are preferred.

The content of the water-soluble gold compound preferably ranges 0.0001 to 1 mol/liter, more preferably 0.002 to 0.03 mols/liter, based on gold. If the content is smaller than the above range, there is concern that the deposition rate lowers, and the content exceeding the above range may result in poor economy.

The complexing agent contained in the electroless gold plating bath of the present invention may be any known complexing agents used in electroless plating baths and includes, for example, phosphoric acid, boric acid, citric acid, gluconic acid, tartaric acid, lactic acid, malic acid, ethylenediamine, triethanolamine, ethylenediaminetetraacetic acid, nitrilotriacetic acid, diethylenetriaminepentacetic acid, hydroxyethylethylenediamine tetraacetic acid, triethylenetetramine hexaacetic acid, 1,3-propanediamine tetraacetic acid, 1,3-diamino-2-hydroxypropane tetraacetic acid, hydroxyethyliminodiacetic acid, dihydroxyl glycine, glycol ether diamine tetraacetic acid, dicarboxymethylglutamic acid, hydroxyethylidenediphosphoric acid, ethylenediamine tetra(methylenephosphoric acid), or alkali metal (e.g. sodium or potassium) salts, alkaline earth metal salts or ammonium salts thereof, or the like.

The concentration of the complexing agent preferably ranges 0.001 to 1 mol/liter, more preferably 0.01 to 0.5 mols/liter. If the concentration is smaller than the above range, the deposition rate may lower by the action of an eluted metal, and the concentration exceeding the above range may result in poor economy in some case.

Formaldehyde metabisulfite adducts are contained in the electroless gold plating bath of the present invention. Specific examples of the formaldehyde metabisulfite adduct include sodium formaldehyde metabisulfite, potassium formaldehyde metabisulfite, ammonium formaldehyde metabisulfite and the like.

The concentration of these formaldehyde metabisulfite adducts preferably ranges 0.0001 to 0.5 mols/liter, more preferably 0.001 to 0.3 mols/liter. If the concentration is smaller than the above range, there is concern that underlying nickel is corroded. Over the above range, the bath may become instable.

The electroless gold plating bath of the invention contains an amine compound represented by the following general formula (1) or (2).

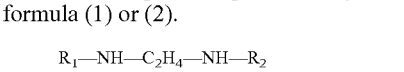

$$R_1—NH—C_2H_4—NH—R_2 \quad (1)$$

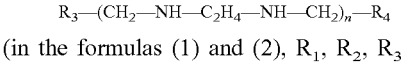

$$R_3—(CH_2—NH—C_2H_4—NH—CH_2)_n—R_4 \quad (2)$$

(in the formulas (1) and (2), $R_1$, $R_2$, $R_3$ and $R_4$ represent —OH, —$CH_3$, —$CH_2OH$, —$C_2H_4OH$, —$CH_2N(CH_3)_2$, —$CH_2NH(CH_2OH)$, —$CH_2NH(C_2H_4OH)$, —$C_2H_4NH(CH_2OH)$, —$C_2H_4NH(C_2H_4OH)$, —$CH_2N(CH_2OH)_2$, —$CH_2N(C_2H_4OH)_2$, —$C_2H_4N(CH_2OH)_2$ or —$C_2H_4N(C_2H_4OH)_2$ and may be the same or different, and n is an integer of 1 to 4). The formaldehyde metabisulfite adduct of the present invention does not act as a reducing agent when using the formaldehyde metabisulfite adduct alone, but causes the reduction action to occur in co-existence with the amine compound.

The concentration of these amine compounds preferably ranges 0.001 to 3 mols/liter, more preferably 0.01 to 1 mol/liter. If the concentration is smaller than above range, there is concern that the deposition rate lowers. Over the above range, the bath may become instable.

The molar ratio in content between the formaldehyde metabisulfite adduct and the amine compound is such that formaldehyde metabisulfite adduct:amine compound=1:30 to 3:1, preferably 1:10 to 1:1. If the aldehyde is present in amounts larger than the above range, there is concern that the bath becomes instable. The concentration of the amine compound over the above range may result in poor economy.

The pH of the electroless gold plating bath of the invention preferably ranges 5 to 10. If the pH is smaller than the above range, there is concern that the deposition rate lowers. Over the above range, the bath may become instable. For a pH adjuster, there can be used sodium hydroxide, potassium hydroxide, ammonia, sulfuric acid, phosphoric acid, boric acid or the like, which is used in ordinary plating baths.

The temperature of the electroless gold plating bath of the present invention preferably ranges 40 to 90° C. Temperatures lower than the above range may lower the deposition rate. Over the above range, the bath may become instable.

When the electroless gold plating bath of the present invention is used and a metal surface is brought into contact with the electroless gold plating bath, the metal surface of a base can be electrolessly gold-plated. In this connection, a gold plated coating of 0.01 to 2 μm in thickness can be formed when the contact time is, for example, at 5 to 60 minutes, and the gold plated coating can be formed at a deposition rate, for example, of 0.002 to 0.03 μm/minute.

For a material of the metal surface (a surface to be plated) of a base, mention can be made of copper, a copper alloy, nickel, a nickel alloy, palladium, a palladium alloy and the like. Examples of the nickel alloy include nickel-phosphorus alloy, nickel-boron alloy and the like, and examples of the palladium alloy include palladium-phosphorus alloy and the like. Such a metal surface may include, aside from a surface of the case where a base itself is made of a metal (alloy), a coating surface where a metallic coating is formed on a base surface. The metallic coating may be either one that is formed by electroplating or one that is formed by electroless plating. In this connection, with the case of nickel, a nickel alloy, palladium and a palladium alloy, it is usual to form those coatings by electroless plating. Moreover, a palladium or palladium alloy coating surface formed on a base through a nickel or nickel alloy coating is suited for electroless gold plating.

The electroless gold plating bath of the present invention can be used for the formation of a gold plated coating, for example, by any of ENIG (Electroless Nickel Immersion Gold), i.e. a method of forming a gold plated coating on an underlying electroless nickel plated coating (formed on copper), DIG (Direct Immersion Gold), i.e. a method of forming a gold plated coating directly on copper, and ENEPIG (Electroless Nickel, Electroless Palladium Immersion Gold), i.e. a method of forming a gold plated coating on an underlying electroless nickel coating (formed on copper) through an electroless palladium coating. In any of the cases, the use of the electroless gold plating bath of the present invention enables a given thickness of a gold plated coating on a nickel surface, a copper surface or a palladium surface within such a range as defined above to be formed.

The electroless gold plating bath and the electroless gold plating method using the same according to the present invention are suited for gold plating, for example, of wiring circuit mounting portions or terminal portions of electronic parts such as printed circuit boards, IC packages and the like.

It will be noted that with the plating bath of the present invention, a good coating can be obtained in case where the metallic surface (a surface to be plated) is formed of copper and when copper is an underlying layer, good solder bonding characteristics such as of suppressing copper from oxidation and diffusion can be obtained. Also, by thickening the coating, it can be used to wire bonding. In addition, the plating bath of the invention allows a gold coating of good quality to be deposited on palladium and is optimized in application to lead-free solder bonding or wire bonding.

EXAMPLES

Examples and Comparative Example are shown to more particularly illustrate the present invention, which should not be construed as limited to the following examples.

Examples 1 to 4, Comparative Examples 1, 2

Gold plating baths having compositions indicated in Table 1 were used, and treatments indicated in Tables 2 to 4 were carried out relative to copper-clad printed boards by (1) direct electroless gold plating process, (2) nickel/gold plating process and (3) nickel/palladium/gold process, followed by immersion of the thus treated copper-clad printed boards in gold plating baths for gold plating. The thickness of the resulting gold-plated coating and the presence or absence of nickel surface corrosion after separation of gold in the nickel/gold plating process are shown in Table 1.

TABLE 1

| | | Example | | | | Comparative Example | |
|---|---|---|---|---|---|---|---|
| | | 1 | 2 | 3 | 4 | 1 | 2 |
| Bath Composition | Potassium gold cyanide (g/liter) | 2 | 2 | 2 | 2 | 2 | 2 |
| | Potassium phosphate (g/liter) | 10 | 10 | 10 | 10 | 10 | 10 |
| | Ethylenediamine tetraacetic acid (g/liter) | 10 | 10 | 10 | 10 | 10 | 10 |
| | Sodium formaldehyde metabisulfite (g/liter) | 2 | 2 | 2 | 2 | 2 | 2 |
| | Amine compound-1 (g/liter) | 10 | | | | | |
| | Amine compound-2 (g/liter) | | 10 | | | | |
| | Amine compound-3 (g/liter) | | | 10 | | | |
| | Amine compound-4 (g/liter) | | | | 10 | | |
| | Triethanolamine (g/liter) | | | | | 10 | |
| | Triethylenetetramine (g/liter) | | | | | | 10 |
| | pH | 7.1 | 7.1 | 7.1 | 7.1 | 7.1 | 7.1 |
| Thickness of gold coating (μm) | (1) direct electroless gold process | 0.05 | 0.05 | 0.05 | 0.05 | 0.01 | 0.04 |
| | (2) nickel/gold process | 0.06 | 0.0.7 | 0.06 | 0.06 | 0.04 | 0.07 |
| | (3) nickel/palladium/gold process | 0.04 | 0.04 | 0.04 | 0.04 | 0.01 or below | 0.04 |
| Nickel surface corrosion after separation of gold in the nickel/gold process (2) | | none | none | none | none | yes | yes |

Amine compound-1: $HOC_2H_4—NH—C_2H_4—NH—C_2H_4OH$
Amine compound-2: $C_2H_5—NH—C_2H_4—NH—C_2H_4OH$
Amine compound-3: $C_2H_5—NH—C_2H_4—NH—C_2H_4—NH—C_2H_4—NH—C_2H_4OH$
Amine compound-4: $(CH_3)_2NC_2H_4—NH—C_2H_4—NH—C_2H_4N(CH_3)_2$ (1) Direct Electroless Gold Plating Process

TABLE 2

| | | Temperature (° C.) | Time (minutes) |
|---|---|---|---|
| Cleaner | ACL-009 made by C. Uyemura & Co., Ltd. | 50 | 5 |
| Soft etching | Sodium persulfate: 100 g/liter $H_2SO_4$: 20 g/liter | 25 | 1 |
| Gold plating | Baths indicated in Table 1 | 80 | 10 |

Water washing carried out between the respective steps.

(2) Nickel/Gold Plating Process

TABLE 3

| | | Temperature (° C.) | Time (minutes) |
|---|---|---|---|
| Cleaner | ACL-009 made by C. Uyemura & Co., Ltd. | 50 | 5 |
| Soft etching | Sodium persulfate: 100 g/liter $H_2SO_4$: 20 g/liter | 25 | 1 |
| Acid cleaning | $H_2SO_4$: 50 g/liter | 25 | 1 |
| Activator | MNK-4, made by C. Uyemura & Co., Ltd. | 30 | 2 |

TABLE 3-continued

| | | Temperature (° C.) | Time (minutes) |
|---|---|---|---|
| Electroless nickel plating | NPR-4, made by C. Uyemura & Co., Ltd. | 80 | 30 |
| Gold plating | Baths indicated in Table 1 | 80 | 10 |

Water washing carried out between the respective steps.

(3) Nickel/Palladium/Gold Process

TABLE 4

| | | Temperature (° C.) | Time (minutes) |
|---|---|---|---|
| Cleaner | ACL-009 made by C. Uyemura & Co., Ltd. | 50 | 5 |
| Soft etching | Sodium persulfate: 100 g/liter $H_2SO_4$: 20 g/liter | 25 | 1 |
| Acid cleaning | $H_2SO_4$: 50 g/liter | 25 | 1 |
| Activator | MNK-4, made by C. Uyemura & Co., Ltd. | 30 | 2 |
| Electroless nickel plating | NPR-4, made by C. Uyemura & Co., Ltd. | 80 | 30 |
| Electroless palladium plating | TPD-30, made by C. Uyemura & Co., Ltd. | 50 | 5 |
| Gold plating | Baths indicated in Table 1 | 80 | 10 |

Water washing carried out between the respective steps.

In Examples 1 to 4, a good gold thickness was obtained and no nickel surface corrosion was confirmed after the separation of gold in the nickel/gold process.

In Examples 1 to 4, good gold coating thicknesses were obtained and no nickel surface corrosion after separation of gold in the nickel/gold process was recognized.

In Comparative Example 1, the immersion reaction alone proceeded and the coating thickness became insufficient in the direct electroless gold process and nickel/gold process, and little deposition was found in the nickel/palladium/gold process.

In Comparative Examples 1, 2, corrosion on the nickel surface after separation of gold in the nickel/gold process was recognized.

From the foregoing, it will be seen that the electroless gold plating baths of the invention are excellent in the following respects.

(1) Corrosion on the nickel surface after separation of gold is unlikely to occur.

(2) When thickened, a good coating appearance is shown.

(3) Thickening of a gold plated coating is possible in one solution.

Japanese Patent Application No. 2006-328891 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An electroless gold plating bath, comprising a water-soluble gold compound, a complexing agent, a formaldehyde metabisulfite adduct, and an amine compound represented by the following general formula (1) or (2):

$$R_1—NH—C_2H_4—NH—R_2 \quad (1)$$

$$R_3—(CH_2—NH—C_2H_4—NH—CH_2)_n—R_4 \quad (2)$$

wherein in the formulas (1) and (2), $R_1$, $R_2$, $R_3$ and $R_4$ represent —OH, $—CH_3$, $—CH_2OH$, $—C_2H_4OH$, $—CH_2N(CH_3)_2$, $—CH_2NH(CH_2OH)$, $—CH_2NH(C_2H_4OH)$, $—C_2H_4NH(CH_2OH)$, $—C_2H_4NH(C_2H_4OH)$, $—CH_2N(CH_2OH)_2$, $—CH_2N(C_2H_4OH)_2$, $—C_2H_4N(CH_2OH)_2$ or $—C_2H_4N(C_2H_4OH)_2$ and may be the same or different, and n is an integer of 1 to 4.

2. The electroless gold plating bath according to claim 1, wherein a molar ratio between the formaldehyde metabisulfite adduct and the amine compound is such that formaldehyde metabisulfite adduct:amine compound =1:30 to 3:1.

3. The electroless gold plating bath according to claim 1, wherein said water-soluble gold compound consists of a gold cyanide salt.

4. An electroless gold plating method, comprising a step of plating a metal surface of a base by the electroless gold plating bath defined in claim 1.

5. The electroless gold plating method according to claim 4, wherein the metal surface of said base is a surface of copper or a copper alloy.

6. The electroless gold plating method according to claim 4, wherein the metal surface of the base is a surface of nickel or a nickel alloy.

7. The electroless gold plating method according to claim 6, wherein said nickel or nickel alloy is an electroless nickel or electroless nickel alloy plated coating.

8. The electroless gold plating method according to claim 4, wherein the metal surface of said base is a surface of palladium or a palladium alloy.

9. The electroless gold plating method according to claim 8, wherein said palladium or palladium alloy is an electroless palladium or electroless palladium alloy plated coating.

10. The electroless gold plating method according to claim 4, wherein the metal surface of said base is a surface of an electroless palladium or electroless palladium alloy plated coating formed on an electroless nickel or electroless nickel alloy plated coating.

11. The electroless gold plating method according to claim 4, wherein a metal surface of an electronic part is plated by said electroless gold plating bath.

* * * * *